US008216078B1

(12) United States Patent
Yovanovich et al.

(10) Patent No.: US 8,216,078 B1
(45) Date of Patent: Jul. 10, 2012

(54) BILLIARD BALL RACK AND USE THEREOF

(76) Inventors: David A. Yovanovich, Salt Lake City, UT (US); Mark A. Vester, Juneau, AK (US)

( * ) Notice: Subject to any disclaimer, the term of this patent is extended or adjusted under 35 U.S.C. 154(b) by 0 days.

(21) Appl. No.: 12/765,015

(22) Filed: Apr. 22, 2010

Related U.S. Application Data

(62) Division of application No. 11/938,783, filed on Nov. 13, 2007, now Pat. No. 7,731,596.

(51) Int. Cl.
*A63D 15/00* (2006.01)

(52) U.S. Cl. ..... 473/40; 473/1

(58) Field of Classification Search ..... 473/40, 473/41, 21, 22, 26
See application file for complete search history.

(56) References Cited

U.S. PATENT DOCUMENTS

| | | | | | |
|---|---|---|---|---|---|
| 464,745 | A | * | 12/1891 | Sweet | 473/40 |
| 916,193 | A | | 3/1909 | Pierce | |
| 1,052,461 | A | | 2/1913 | Chase | |
| 2,405,677 | A | | 8/1946 | Volpe | |
| 2,422,939 | A | | 6/1947 | Volpe | |
| 3,253,826 | A | | 5/1966 | Luttrell | |
| 3,672,671 | A | | 6/1972 | Merola | |
| 3,992,005 | A | | 11/1976 | Richey | |
| 4,005,861 | A | | 2/1977 | Tomczak | |
| 4,307,881 | A | | 12/1981 | Jaworski | |
| 4,452,450 | A | | 6/1984 | Cayton | |
| 4,768,781 | A | | 9/1988 | McMillin | |
| 4,903,965 | A | * | 2/1990 | Smith | 473/40 |
| 5,376,054 | A | | 12/1994 | Kwasny et al. | |
| 5,531,646 | A | * | 7/1996 | Boyle | 473/40 |
| 5,556,341 | A | | 9/1996 | Bonn | |
| 5,601,495 | A | | 2/1997 | Silverman | |
| 5,735,750 | A | | 4/1998 | Silverman | |
| 5,916,032 | A | | 6/1999 | Stoll | |
| 5,997,404 | A | | 12/1999 | Sardo | |
| 6,312,342 | B1 | | 11/2001 | Newsome | |
| 6,595,862 | B2 | * | 7/2003 | Porper | 473/40 |
| 7,166,033 | B2 | | 1/2007 | Krajeski | |
| 7,785,209 | B1 | * | 8/2010 | Targosz et al. | 473/40 |
| 2001/0044343 | A1 | | 11/2001 | Rupert | |
| 2005/0009614 | A1 | | 1/2005 | Knight | |
| 2005/0159230 | A1 | | 7/2005 | Tudek | |
| 2007/0191124 | A1 | * | 8/2007 | Thorpe | 473/40 |

* cited by examiner

*Primary Examiner* — Mitra Aryanpour
(74) *Attorney, Agent, or Firm* — Michael R. Schramm

(57) ABSTRACT

The improved billiard rack is an invention that allows a user to quickly and easily rack or position a set of billiard balls without the inconvenience or necessity of actuating an auxiliary ball positioning device. The rack includes NEOPRENE or the like compressible members that cause a compressive load to be placed upon a group of billiard balls when the rack is positioned on a set of balls which further causes the group of balls to be tightly and properly grouped or racked. The rack further includes angled walls that provide for removal of the rack from a group of balls without the walls colliding with the balls. The rack further includes feet upon which the rack may be rotatingly removed from a set of balls by rotating the rack in an upwards rearwards rotation motion away from the group of balls. The feet preferably include alignment marks that may be aligned with corresponding marks on a playing surface so as to properly, accurately, and consistently position the rack.

20 Claims, 6 Drawing Sheets

BILLIARD BALL RACK AND USE THEREOF

CROSS REFERENCE TO RELATED APPLICATIONS

This application is a divisional application of U.S. patent application Ser. No. 11/938,783 filed Nov. 13, 2007 and since issued as U.S. Pat. No. 7,731,596 which is incorporated herein by reference in its entirety.

BACKGROUND OF THE INVENTION

1. Field of the Invention

This invention relates to racks and like devices for use in "racking" or position balls such as billiard balls into a proper formation such as a triangular formation in preparation to initiate a game such as a game of billiards.

2. Description of the Related Art

In playing the game of billiards or pool or the like, it is important to achieve "tight rack" of balls or balls that have been tightly racked, so that when breaking the rack of balls such as with a cue ball, the balls will efficiently transmit energy into surrounding balls and such that a good break is achieved. A good break would for instance be defined as significant separation and movement of the balls upon impact of at least one previously racked ball by a cue ball. A poor break would for instance be defined as little separation and movement of the balls upon impact of at least one previously racked ball by a cue ball. Such a poor break is often due to a loosely or improperly racked set of balls. A loosely or improperly racked set of balls may be due to a combination of factors including dimensional variation among the balls to be racked, inexperience of the user of the rack, and a rack that is not adapted to providing a properly and tightly racked set of balls. The disclosed invention seeks to overcome the noted problems with racking balls.

Many improvements to racks or rack like devices have been devised to improve the racking of balls. For instance, the following list of US patents and applications all disclose inventions related to billiard type racks and are incorporated herein by reference: U.S. Pat. Nos. 916,193, 1,052,461, 2,405,677, 2,422,939, 3,253,826, 3,672,671, 3,992,005, 4,005,861, 4,307,881, 4,452,450, 4,476,781, 4,903,965, 5,376,054, 5,556,341, 5,601,495, 5,735,750, 5,916,032, 5,997,404, 6,312,342, 6,595,862, 7,166,033, 20010044343, 20050009614, and 20050159230. However, the inventive concepts disclosed in the preceding list of patents include several deficiencies. Problems with the prior art include for instance complicated racks having moving parts, racks requiring the user to manually actuate a rack mechanism once a rack is placed on a set of balls to tighten the rack of balls, racks having tightening or compression members of inferior, non-resilient, or low elasticity materials, and racks being void of handles for use in removal of the rack from the racked set of balls. Furthermore, a rack that overcomes all of the above cited problems in a single product is heretofore unknown.

SUMMARY OF THE INVENTION

The present invention has been developed in response to the present state of the art, and in particular, in response to the rack devices that were described to be lacking in the art. Accordingly, the present invention is an improved rack that comprises a substantially triangular shaped billiard ball rack having inwardly canted walls to facilitate removal of the rack from racked balls without disturbing the racked balls, resilient compression members for causing a compression load to be induced into balls to cause balls to become tightly packed or racked, handles to facilitate manipulation of the rack, feet for use in rotating removal of the rack from racked balls, and locating notches for use in locating and aligning the rack. The rack is adapted such that without any moving parts (other than the compression movement of the compression members), the rack is usable in tightly and properly racking a set of billiard balls or the like. Such proper racking is accomplished by placing the rack over a predetermined number of balls (such as for instance fifteen balls or nine balls), in reaction to contact between the balls and the compression members causing the compression members to compression and causing the balls to tightly pack or "rack", locating the rack in a proper location on a billiard table like playing surface by aligning the alignment notches of the rack with corresponding alignment marks on the playing surface, and rotatinginly removing the rack from the racked balls by rotating the rack upon the feet of the rack to thus remove the rack from the racked balls without disturbing the racked balls. It is noted that racking a set of billiard balls in the disclosed method causes the balls to be tightly and properly racked in a proper predetermined location quickly and with minimal effort on the part of the user.

Reference throughout this specification to features, advantages, or similar language does not imply that all of the features and advantages that may necessarily be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
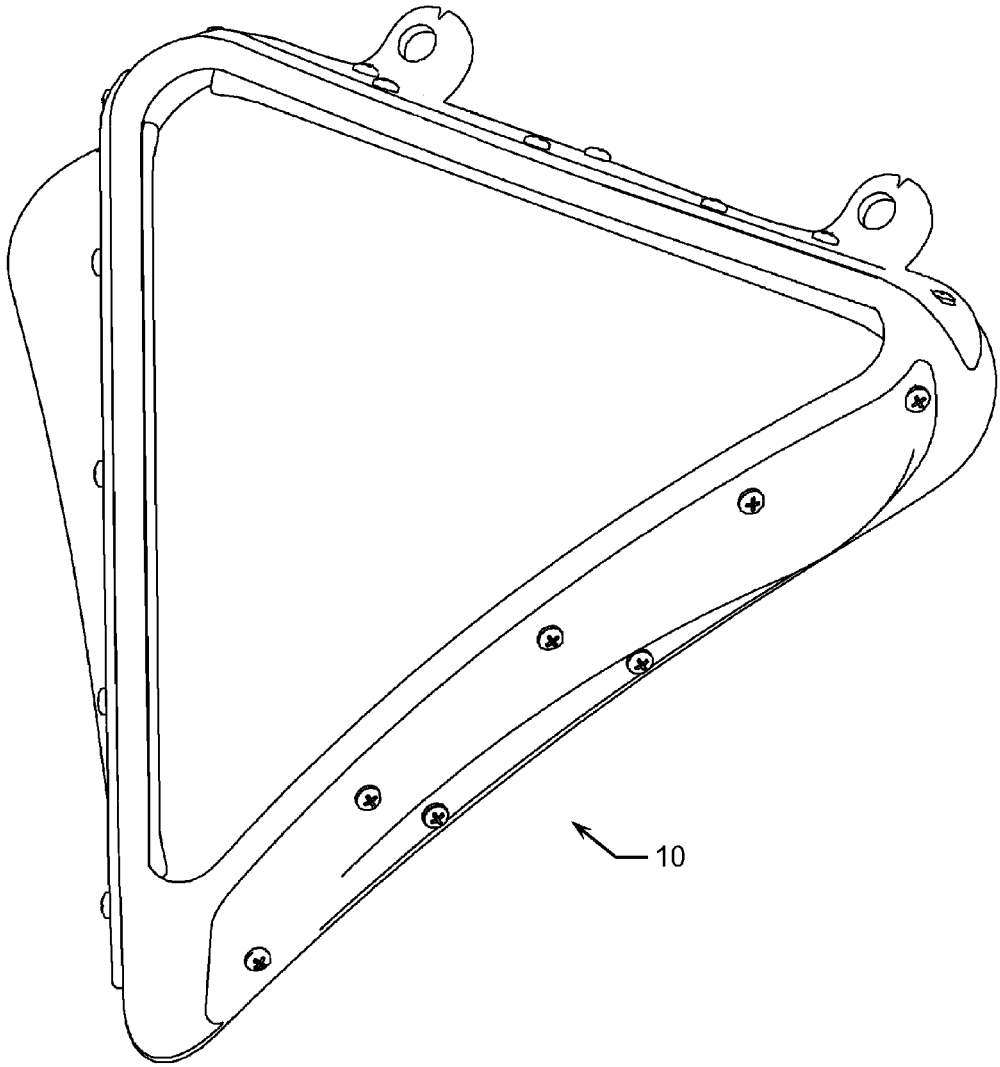
FIG. 1 is an isometric view of a first embodiment of the rack.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The invention is an improved rack for tightly racking billiard or pool balls. The invention preferably includes tapered walls, resilient compression members, handles, feet, and locating notches. In order to facilitate the understanding of the present invention in reviewing the drawings accompanying the specification, a feature list is provided below. It is noted that like features are like numbered throughout all of the figures.

FEATURE TABLE

| # | Feature |
|---|---|
| 10 | Rack |
| 20 | Frame |
| 22 | Frame left wall |
| 23 | Left wall internal surface |
| 24 | Left wall external surface |
| 25 | Left wall slot |
| 26 | Frame right wall |
| 27 | Right wall internal surface |
| 28 | Right wall external surface |
| 29 | Right wall slot |
| 30 | Frame rear wall |
| 31 | Rear wall internal surface |
| 32 | Rear wall external surface |
| 33 | Rear wall slot |
| 34 | Frame left corner |
| 36 | Frame right corner |
| 38 | Frame front corner |

-continued

FEATURE TABLE

| # | Feature |
|---|---|
| 39 | Frame fastening holes |
| 40 | Left retaining plate |
| 41 | Left retaining plate body |
| 42 | Left retaining plate handle |
| 44 | Left retaining plate fastening holes |
| 50 | Right retaining plate |
| 51 | Right retaining plate body |
| 52 | Right retaining plate handle |
| 54 | Right retaining plate fastening holes |
| 60 | Rear retaining plate |
| 61 | Rear retaining plate body |
| 62 | Rear retaining plate fastening holes |
| 64 | Rear retaining plate left foot |
| 66 | Rear retaining plate left locating notch |
| 68 | Rear retaining plate right foot |
| 70 | Rear retaining plate right locating notch |
| 80 | Left compression member |
| 82 | Left compression member bulbous portion |
| 84 | Left compression member retaining flange |
| 90 | Right compression member |
| 92 | Right compression member bulbous portion |
| 94 | Right compression member retaining flange |
| 100 | Rear compression member |
| 102 | Rear compression member bulbous portion |
| 104 | Rear compression member retaining flange |
| 110 | Fastener |
| 120 | Billiard Ball |

Figure 2:
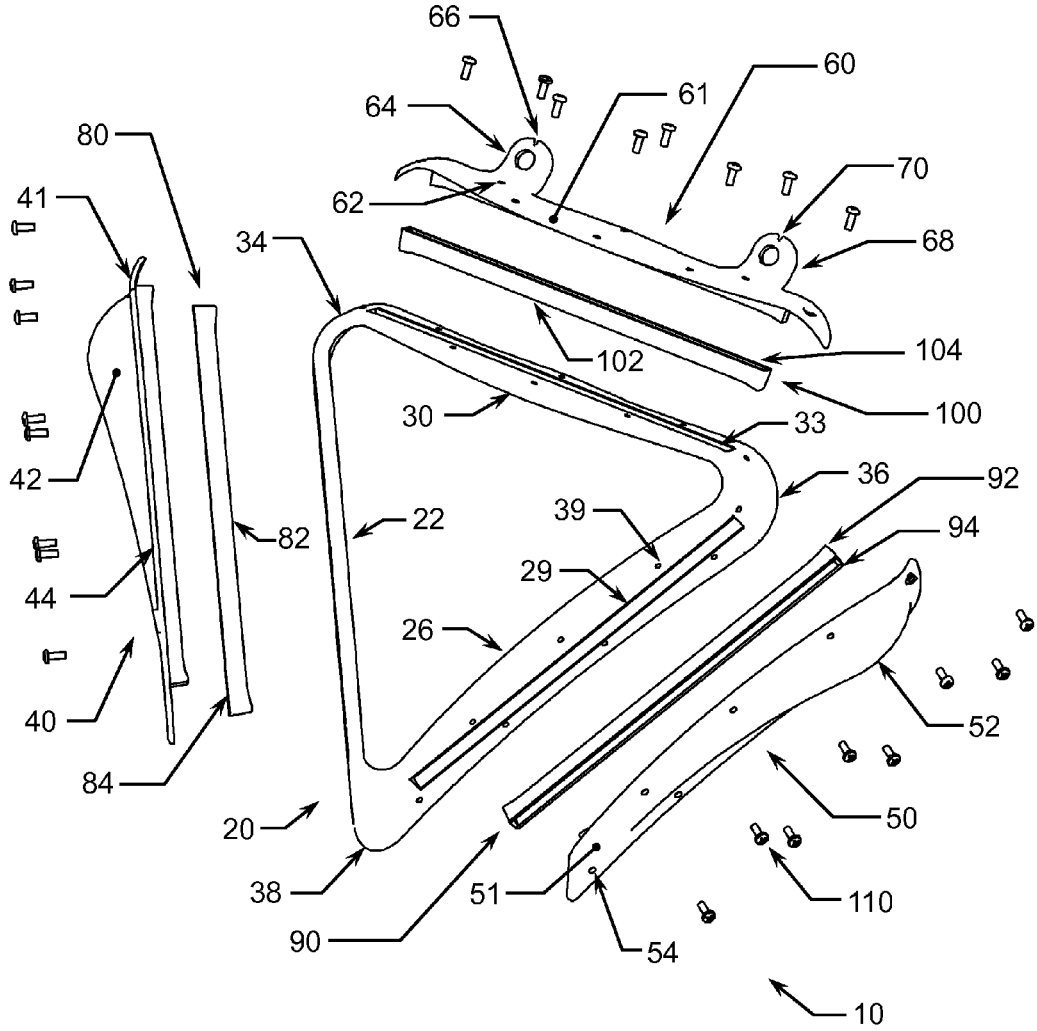
FIG. 2 is an exploded isometric view of a first embodiment of the rack.

Referring now to the drawings and in particular to FIGS. 1 and 2, a first embodiment of the invention is a rack 10 for use in tightly positioning or "racking" a set of billiard balls 120 or the like comprising a frame 20, a left retaining plate 40, a right retaining plate 50, a rear retaining plate 60, a left compression member 80, a right compression member 90, a rear compression member 100, and a plurality of fasteners 110.

Figure 4:
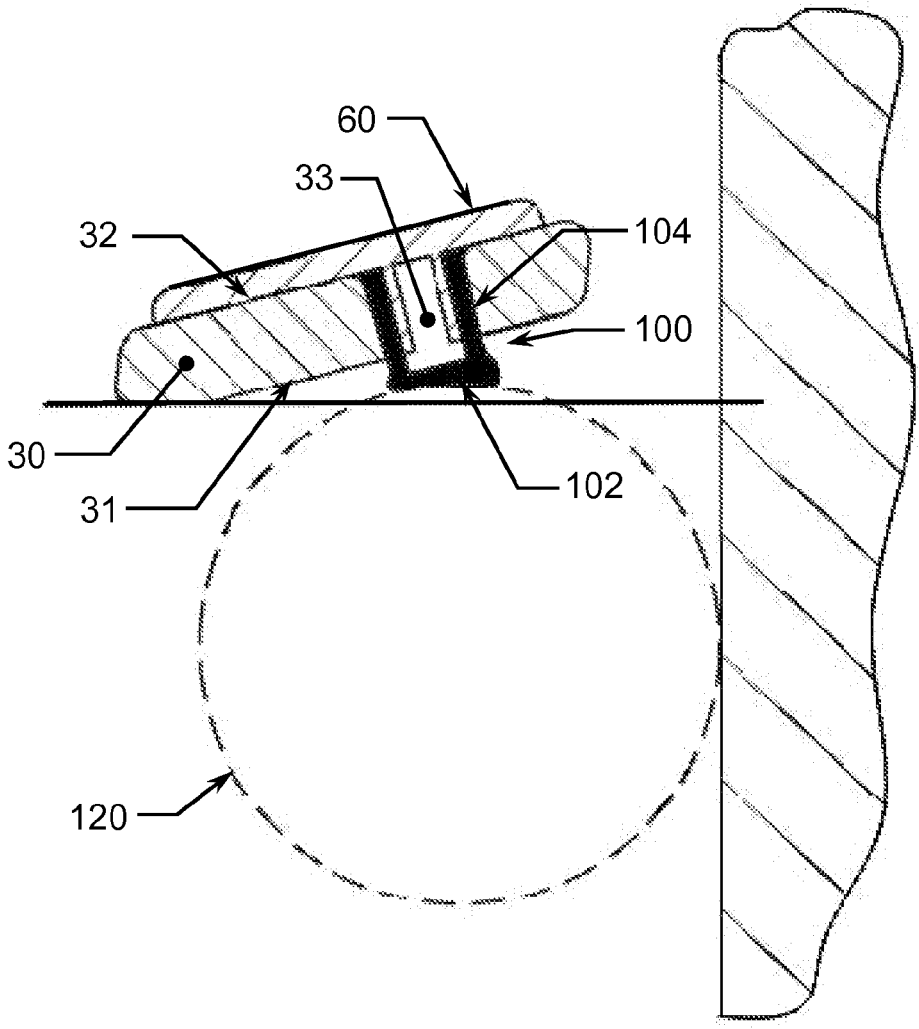
FIG. 4 is a cross-sectional view of a first embodiment of the rack taken substantially at the location indicated in FIG. 3 by the view indication arrows associated with FIG. 4.
Figure 6:
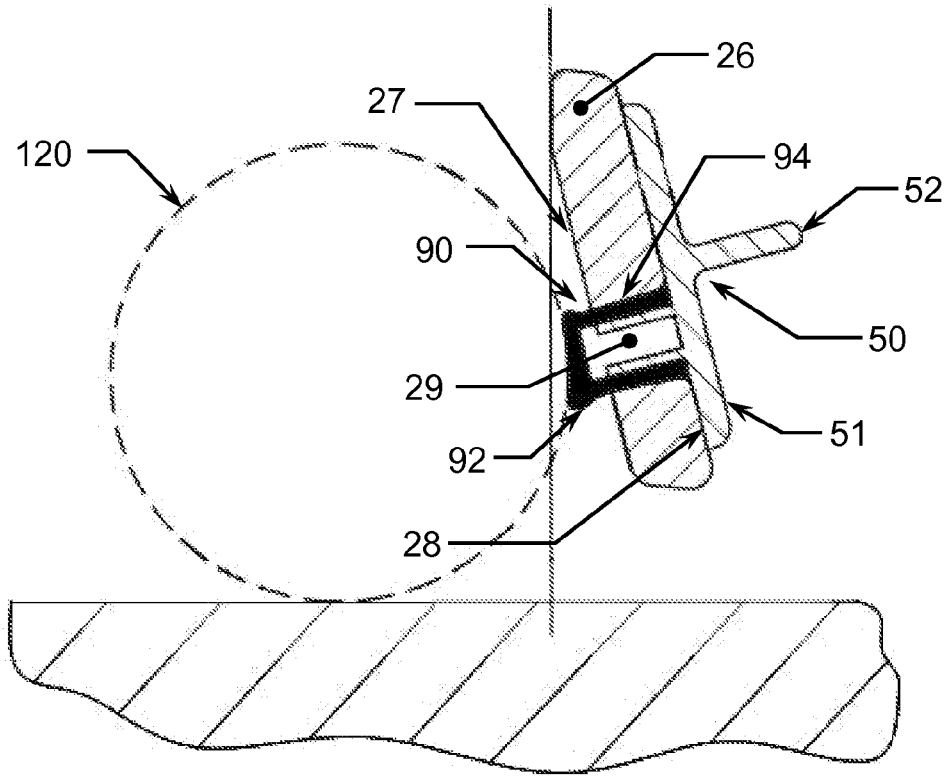
FIG. 6 is a cross-sectional view of a first embodiment of the rack taken substantially at the location indicated in FIG. 3 by the view indication arrows associated with FIG. 6, with FIG. 6 being rotated such that the view is shown in a vertical orientation.
Figure 5:
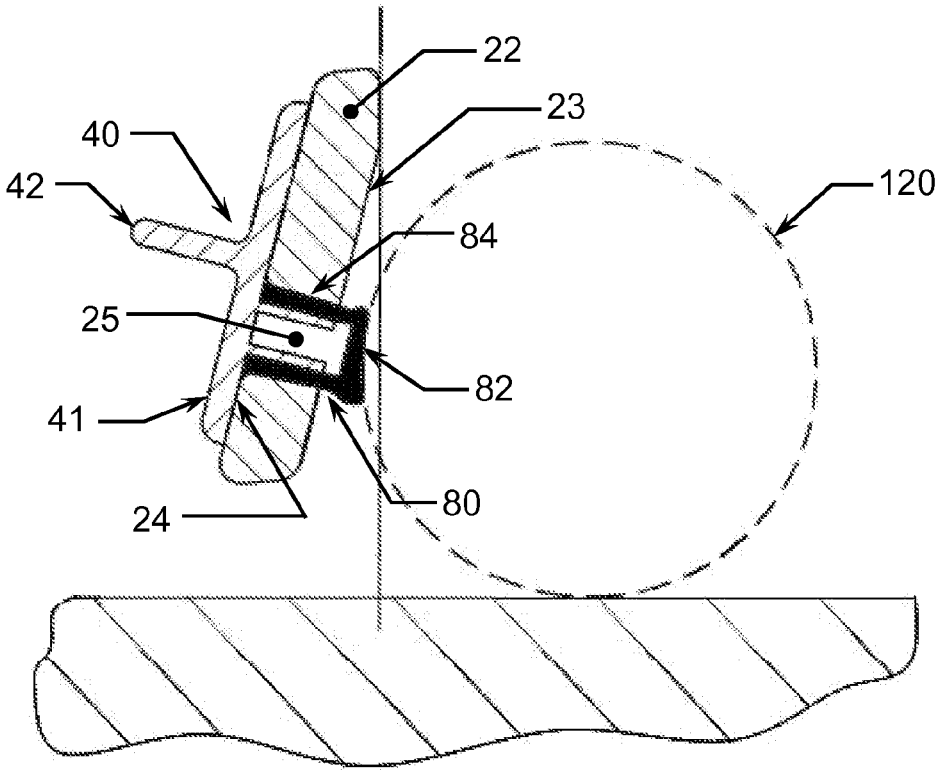
FIG. 5 is a cross-sectional view of a first embodiment of the rack taken substantially at the location indicated in FIG. 3 by the view indication arrows associated with FIG. 5, with FIG. 5 being rotated such that the view is shown in a vertical orientation.

Frame 20 defines a substantially rigid open triangular shaped frame preferably adapted to substantially enclose a group of fifteen billiard balls 120. Frame 20 further comprises a frame left wall 22 having a left wall slot 25, a frame right wall 26 having a right wall slot 29, a frame rear wall 30 having a rear wall slot 33. Left frame wall 22 is connected to right frame wall 26 on a first end of left wall 22 and to rear frame wall 30 on a second end of left wall 22. Further, right frame wall 26 is connected to rear frame wall 30 on a second end of right wall 26. The intersection of left wall 22 and rear wall 30 forms a substantially rounded left corner 34. The intersection of right wall 26 and rear wall 30 forms a substantially rounded right corner 36. And the intersection of left wall 22 and right wall 26 forms a substantially rounded front corner 38. Left wall 22 further defines an internal wall surface 23 and an external wall surface 24. As can be seen in FIG. 5, left wall 22 forms a substantially angled wall such that the upper end of wall 22 angles inward towards the center of rack 22. Right wall 26 further defines an internal wall surface 27 and an external wall surface 28. As can be seen in FIG. 6, right wall 26 forms a substantially angled wall such that the upper end of wall 26 angles inward towards the center of rack 22. Rear wall 30 further defines an internal wall surface 31 and an external wall surface 32. As can be seen in FIG. 4, rear wall 30 forms a substantially angled wall such that the upper end of wall 30 angles inward towards the center of rack 22. It is noted that as opposed to strait or non-angled walls, such canted or angled walls facilitate the removal of the rack 10 from racked balls 120 without disturbing or moving racked balls 120 due to a collision of rack balls 120 by one or more of walls 22, 26, and 30. Additionally, each of walls 22, 26, and 30 include a plurality of fastening holes 39 to accommodate the reception of fasteners 110. It is noted that frame 20 may be constructed of aluminum such as a machined aluminum frame or plastic such as an injection molded frame or of other suitable materials.

Left retaining plate 40 defines a retaining plate having a substantially elongated plate like body member 41 having a fin like member projecting normally from body 41 to define a handle 42. It is noted that in addition to providing a handle for rack 10, handle 42 provides increased stiffness to retaining plate 40. Body 41 is adapted to fit to rack external surface 24 and includes a plurality of fastening holes 44 located in body 41 to accommodate the reception of fasteners 110. It is noted that retaining plate 40 may be constructed of aluminum such as a machined aluminum retaining plate or plastic such as an injection molded retaining plate or of other suitable materials.

Right retaining plate 50 defines a retaining plate having a substantially elongated plate like body member 51 having a fin like member projecting normally from body 51 to define a handle 52. It is noted that in addition to providing a handle for rack 10, handle 52 provides increased stiffness to retaining plate 50. Body 51 is adapted to fit to rack external surface 28 and includes a plurality of fastening holes 54 located in body 51 to accommodate the reception of fasteners 110. It is noted that retaining plate 50 may be constructed of aluminum such as a machined aluminum retaining plate or plastic such as an injection molded retaining plate or of other suitable materials.

Rear retaining plate 60 defines a retaining plate having a substantially elongated plate like body member 61 having a left foot 64 and a right foot 68 extending downward from body 61 and curving outward from body 61. Left foot 64 further includes a left locating notch 66 and right foot 68 further includes a right locating notch 70. Locating notches 66 and 70 provide a location and alignment indication marks for use in properly positioning rack 10 on a billiard playing surface or the like having corresponding alignment marks. Body 61 is adapted to fit to rack external surface 32 and includes a plurality of fastening holes 62 located in body 61 to accommodate the reception of fasteners 110. It is noted that retaining plate 60 may be constructed of aluminum such as a machined aluminum retaining plate or plastic such as an injection molded retaining plate or of other suitable materials.

Left compression member 80 defines a substantially elongated compression member having a bulbous portion 82 connected to at least one retention flange 84. Compression member 80 is formed of a substrate of resilient material such as an elastomer, foam, a closed cell foam, a microcellular urethane foam, a natural rubber, or synthetic rubber that maintains a reaction load when compressed. Compression member 80 further preferably includes a skin or thin film type covering having a coefficient of friction that is less than the coefficient of friction of the base substrate of the compressible member. Specifically, the substrate of compression member 80 is preferably formed of a synthetic rubber such as NEOPRENE which is commercially available from the DuPont Corporation or such as PORON which is commercially available from the Rogers Corporation. Further, the outer skin of compression member 80 is preferably formed of polyester film preferably having a napped finish and sometimes know in the trade as "doe skin".

Right compression member 90 defines a substantially elongated compression member having a bulbous portion 92 connected to at least one retention flange 94. Compression member 90 is formed of a substrate of resilient material such as an elastomer, a foam, a closed cell foam, a microcellular urethane foam, a natural rubber, or synthetic rubber that maintains a reaction load when compressed. Compression member 90 further preferably includes a skin or thin film type covering having a coefficient of friction that is less than the coefficient of friction of the base substrate of the compressible member. Specifically, the substrate of compression member 90 is preferably formed of a synthetic rubber such as NEOPRENE which is commercially available from the DuPont Corporation or such as PORON which is commercially available from the Rogers Corporation. Further, the outer skin of compression member 90 is preferably formed of polyester film preferably having a napped finish and sometimes know in the trade as "doe skin".

Rear compression member 100 defines a substantially elongated compression member having a bulbous portion 102 connected to at least one retention flange 104. Compression member 100 is formed of a substrate of resilient material such as an elastomer, a foam, a closed cell foam, a microcellular urethane foam, a natural rubber, or synthetic rubber that maintains a reaction load when compressed. Compression member 100 further preferably includes a skin or thin film type covering having a coefficient of friction that is less than the coefficient of friction of the base substrate of the compressible member. Specifically, the substrate of compression member 100 is preferably formed of a synthetic rubber such as NEOPRENE which is commercially available from the DuPont Corporation or such as PORON which is commercially available from the Rogers Corporation. Further, the outer skin of compression member 100 is preferably formed of polyester film preferably having a napped finish and sometimes know in the trade as "doe skin".

Fastener 110 defines a common mechanical type fastener as is common to the fastening industry. Specifically, fastener 110 preferably defines a #10 sheet metal screw as is common to the fastening industry. Fastener 110 may of course alternately define a different type of fastener. Fastener 110 is used in assembling compression members 80, 90, and 100 and retaining plates 40, 50, and 60 respectively to frame 20. Alternatively, retaining plates 40, 50, and 60 may be bonded or adhered to frame 20 or retaining plates 40, 50, and 60 and frame 20 may be manufactured as a single integral structure.

Billiard ball 120, while not a part of rack 10, defines a standard billiard ball or the like such as are widely commercially available and are commonly used in playing games of billiards and pool. It is noted that such billiard balls inherently include variation in size and shape from one ball to another ball due to the manufacturing process employed in fabricating such billiard balls.

Rack 10 is assembled such that bulbous portion 82 of left compression member 80 is pressed into and through slot 25 of left wall 22 of frame 20, bulbous portion 92 of right compression member 90 is pressed into and through slot 29 of right wall 26 of frame 20, and bulbous portion 102 of rear compression member 100 is pressed into and through slot 33 of rear wall 30 of frame 20. Rack 10 is further assembled such that left retaining plate 40 is fastened to external wall surface 24 of left wall 22 of frame 20 by means of fasteners 110 being retentatively inserted into fastening holes 39 and 44 so as to "sandwich" left compression member 80 between left retaining plate 40 and frame left wall 22, right retaining plate 50 is fastened to external wall surface 28 of right wall 26 of frame 20 by means of fasteners 110 being retentatively inserted into fastening holes 39 and 54 so as to "sandwich" right compression member 90 between right retaining plate 50 and frame right wall 26, and rear retaining plate 60 is fastened to external wall surface 32 of rear wall 30 of frame 20 by means of fasteners 110 being retentatively inserted into fastening holes 39 and 62 so as to "sandwich" rear compression member 100 between rear retaining plate 60 and frame rear wall 30.

Figure 3:
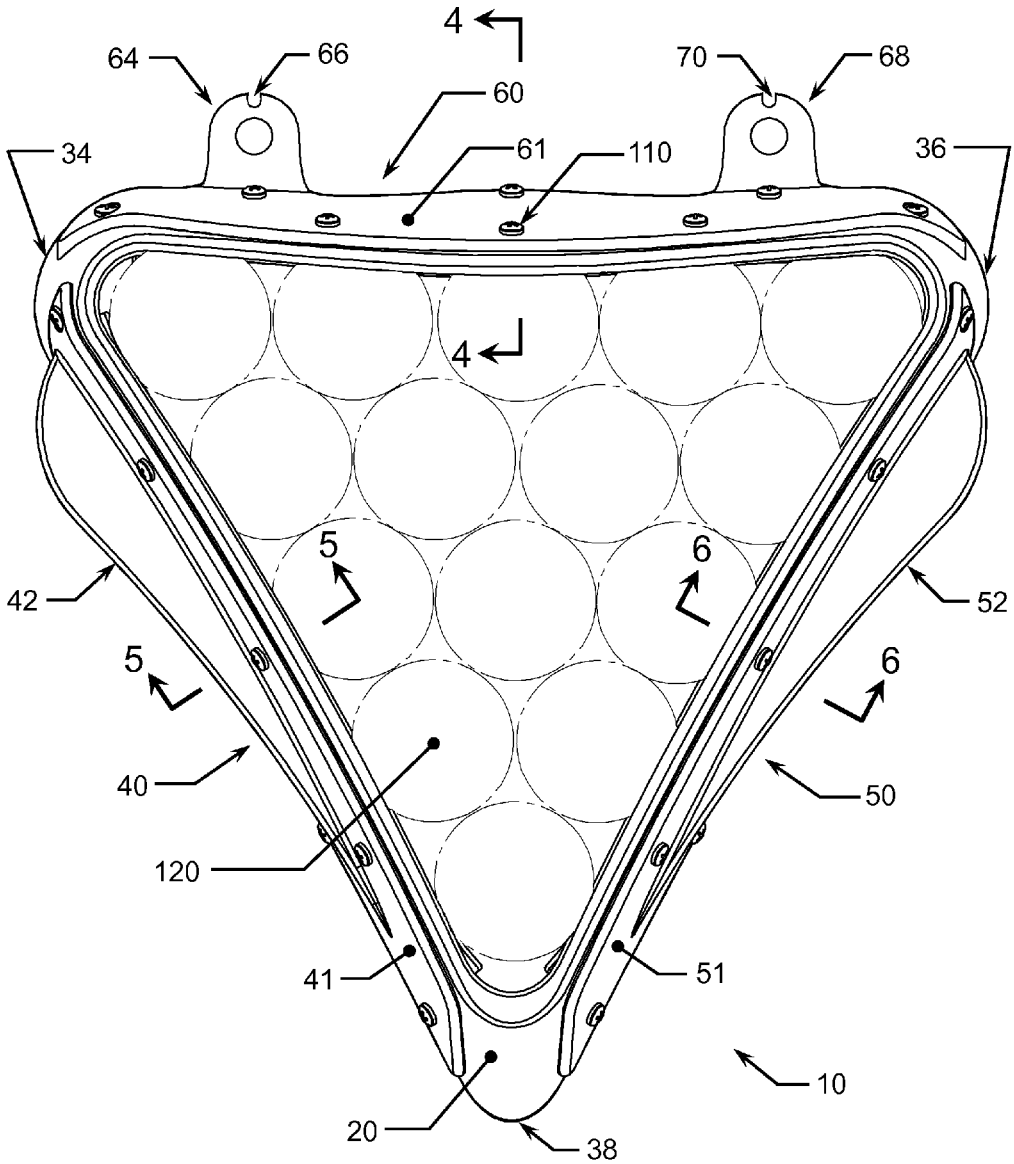
FIG. 3 is a plan view of a first embodiment of the rack, billiard balls are shown for reference in the rack.
Figure 7:
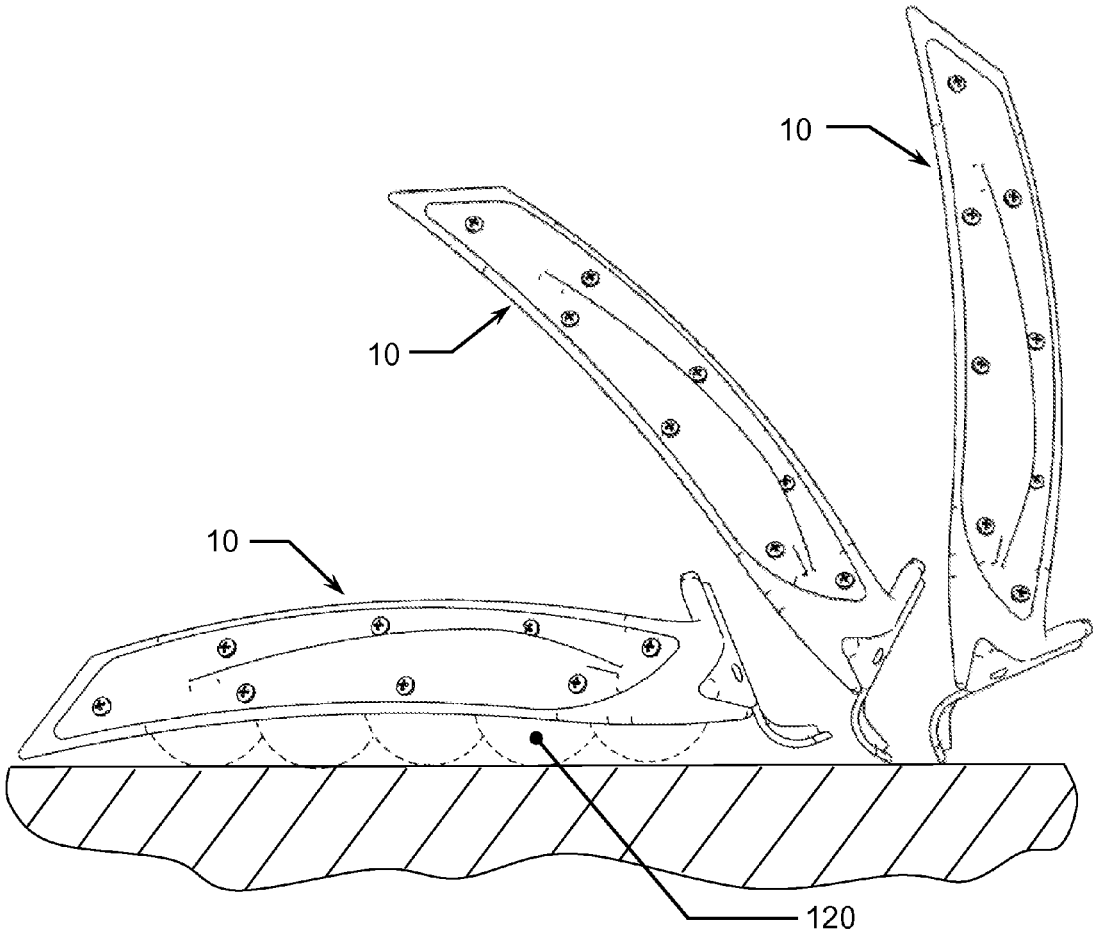
FIG. 7 is a side view of a first embodiment of the rack depicting the rack in various stages of removal so as to illustrate the rack removal method.

In practice, assembled rack 10 is placed upon a group of billiard balls 120 that are resting on a playing surface as shown in FIG. 3. Rack 10 is preferably lowered on balls 120 until feet 64 and 68 and front corner 38 come nearly into contact with the playing surface. Such positioning of rack 10 causes balls 120 to be tightly forced together or properly racked by means of compression members 80, 90, and 100 being compressed and correspondingly inducing a compressive load into balls 120 as shown in FIGS. 4, 5, and 6. Rack 10 may then be positioned as needed on the playing surface by aligning locating notches 66 and 70 with corresponding marks on the playing surface. It is noted that conventional rack location practice requires the user of a conventional rack to guess if the conventional rack is properly located due to a conventional billiard system causing the conventional location spot to be covered by the conventional rack and balls. Once positioned to a desired location, rack 10 is removed from balls 120 by grasping handles 42 and 52, and rotating rack 10 upwards about a theoretical axis near feet 64 and 68 as shown in FIG. 7 such that rack 10 is removed from balls 120 without disturbing balls 120. It is noted that upon removal of rack 10 from balls 120 that the compression members 80,90, and 100 begin to return to their original, uncompressed, or equilibrium state such that rack 10 is readied for additional use. It is further noted that due to the angle of walls, as opposed to straight vertical walls, the ease of removal of rack 10 without disturbing balls 120 is substantially increased.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A method for use in tightly positioning balls by placing a rack on a group of balls and rotating said rack off of said balls without the need to perform a secondary actuation step in order to position said balls, said method comprising the steps of:

providing a rack, said rack having a frame defining an open frame having a center and a plurality of frame walls, at least one of said frame walls being angled such that an upper frame wall end is positioned closer to said frame center than is a lower frame wall end, and wherein said rack includes at least one foot extending from said rack, said at least one foot including an alignment mark, and wherein a plurality of said frame walls include at least one resilient compressible member retentively positioned against an inner surface thereof, causing a plurality of balls resting on a playing surface to be grouped tightly together into a predetermined configuration by placing the rack upon said plurality of balls, positioning said balls at a predetermined location on said playing surface by aligning said at least one alignment mark with at least one corresponding alignment mark on said playing surface, and removing said rack from said balls by rotating said rack upwards on said at least one foot such that said rack is removed from said balls without disturbing said balls.

2. The method of claim 1, wherein said frame defines a single integral structural member.

3. The method of claim 1, wherein said rack defines a substantially triangular shaped rack.

4. The method of claim 1, wherein each wall of said plurality of walls includes a resilient compressible member connected to an inner surface of said each wall.

5. The method of claim 1, wherein said frame includes at least one retaining plate attached to said frame, and wherein attachment of said at least one retaining plate to said frame causes said at least one compressible member to be secured to said frame.

6. The method of claim 1, wherein said rack includes at least one fin extending from said rack to form a rack handle.

7. The method of claim 1, wherein said compressible member defines a compressible member defining a synthetic foam rubber substrate connected to an outer skin.

8. The method of claim 7, wherein said skin defines a polyester skin.

9. A method for use in tightly racking balls by placing a rack on a group of balls and rotating said rack off of said balls without the need to perform a secondary actuation step in order to position said balls, said method comprising the steps of:

providing a rack, said rack having a frame defining an open frame having a center and a plurality of frame walls, and wherein said rack includes at least one foot extending from said rack, and wherein a plurality of said frame walls include at least one resilient compressible member retentively positioned against an inner surface thereof, causing a plurality of balls resting on a playing surface to be grouped tightly together into a predetermined configuration by placing the rack upon said plurality of balls, and removing said rack from said balls by rotating said rack upwards on said at least one foot such that said rack is removed from said balls without disturbing said balls.

10. The method of claim 9, wherein said method includes the step of positioning the balls at a predetermined location on said playing surface by aligning said at least one alignment mark with at least one corresponding alignment mark on said playing surface.

11. The method of claim 9, wherein said rack defines a substantially triangular shaped rack.

12. The method of claim 9, wherein said frame includes at least one retaining plate attached to said frame, said at least one retaining plate having at least one fin extending from said retaining plate to form a handle, and wherein attachment of said at least one retaining plate to said frame causes said at least one compressible member to be secured to said frame.

13. The method of claim 9, wherein said compressible member defines a compressible member defining a synthetic foam rubber substrate connected to an outer skin.

14. A method for use in tightly racking balls by placing a rack on a group of balls and rotating said rack off of said balls without the need to perform a secondary actuation step in order to position said balls, said method comprising the steps of:

providing a rack, said rack having a frame defining an open frame having a center and a plurality of frame walls, at least one of said frame walls being angled such that an upper frame wall end is positioned closer to said frame center than is a lower frame wall end, and wherein said rack includes at least one foot extending from said rack, said at least one foot including an alignment mark, and wherein a plurality of said frame walls include at least one resilient compressible member retentively positioned against an inner surface thereof, placing said rack upon a plurality of balls resting on a playing surface, and removing said rack from said balls by rotating said rack upwards on said at least one foot such that said rack is removed from said balls without disturbing said balls.

15. The method of claim 14, wherein said method includes at least one of the steps of causing said balls to be grouped together into a predetermined configuration and positioning the balls at a predetermined location on said playing surface by aligning said at least one alignment mark with at least one corresponding alignment mark on said playing surface.

16. The method of claim 14, wherein said frame defines a single integral structural member.

17. The method of claim 14, wherein said rack defines a substantially triangular shaped rack.

18. The method of claim 14, wherein each wall of said plurality of walls includes a resilient compressible member connected to an inner surface of said each wall.

19. The method of claim 14, wherein said frame includes at least one retaining plate attached to said frame, said at least one retaining plate having at least one fin extending from said retaining plate to form a handle, and wherein attachment of said at least one retaining plate to said frame causes said at least one compressible member to be secured to said frame.

20. The method of claim 14, wherein said compressible member defines a compressible member defining a synthetic foam rubber substrate connected to an outer skin.

* * * * *